US010596811B2

(12) United States Patent
Ikuta et al.

(10) Patent No.: US 10,596,811 B2
(45) Date of Patent: Mar. 24, 2020

(54) TABLET PRINTING APPARATUS AND TABLET PRINTING METHOD

(71) Applicant: SHIBAURA MECHATRONICS CORPORATION, Yokohama-shi (JP)

(72) Inventors: Ryo Ikuta, Yokohama (JP); Hitoshi Aoyagi, Yokohama (JP); Azusa Hirano, Yokohama (JP); Hikaru Hoshino, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 15/567,789

(22) PCT Filed: Apr. 19, 2016

(86) PCT No.: PCT/JP2016/062342

§ 371 (c)(1),
(2) Date: Oct. 19, 2017

(87) PCT Pub. No.: WO2016/171119

PCT Pub. Date: Oct. 27, 2016

(65) Prior Publication Data

US 2018/0086059 A1 Mar. 29, 2018

(30) Foreign Application Priority Data

Apr. 21, 2015 (JP) ..... 2015-087122

(51) Int. Cl.
*B41J 29/38* (2006.01)
*B41J 2/045* (2006.01)
(Continued)

(52) U.S. Cl.
CPC ..... *B41J 2/04586* (2013.01); *B41J 2/165* (2013.01); *B41J 3/407* (2013.01); *B41J 3/4073* (2013.01);
(Continued)

(58) Field of Classification Search
USPC ..... 347/16, 19
See application file for complete search history.

(56) References Cited

U.S. PATENT DOCUMENTS

2004/0233244 A1* 11/2004 Elgee ..... B41J 29/393 347/19
2009/0237427 A1* 9/2009 Kumagai ..... G03G 21/1647 347/8
(Continued)

FOREIGN PATENT DOCUMENTS

JP H04-284257 A 10/1992
JP H06-143539 A 5/1994
(Continued)

OTHER PUBLICATIONS

International Search Report for International Application No. PCT/JP2016/062342 dated Jun. 28, 2016.

*Primary Examiner* — Lam S Nguyen
(74) *Attorney, Agent, or Firm* — Kratz, Quintos & Hanson, LLP

(57) ABSTRACT

[Problem to be Solved]
To provide a tablet printing apparatus that can prevent drying of ink on the tip end of each nozzle of an inkjet printing mechanism, when a tablet does not arrive at a print position.
[Solution]
A tablet printing apparatus includes: conveyor mechanism 17 that conveys sequentially fed tablets by moving a conveyor belt 171; an inkjet printing mechanism that performs printing on a tablet in a print position; a suction mechanism 174*a* that holds a tablet on the surface of the conveyor belt in a predetermined area including at least the print position by sucking in air; determination means (S15) that determines whether a tablet arrives at the print position; and head retreat means (32, S21) that retreats an inkjet head 31 such that a tip end part of each of the nozzles of the inkjet printing mechanism goes away from the surface of the conveyor belt, when it is determined that a tablet does not arrive at the print position.

8 Claims, 15 Drawing Sheets

(51) Int. Cl.

| | |
|---|---|
| ***B41J 11/00*** | (2006.01) |
| ***B41J 25/304*** | (2006.01) |
| ***B41J 3/407*** | (2006.01) |
| ***B41J 2/165*** | (2006.01) |

(52) U.S. Cl.
CPC ..... *B41J 11/007* (2013.01); *B41J 11/0085* (2013.01); *B41J 11/0095* (2013.01); *B41J 25/304* (2013.01); *B41J 2002/16502* (2013.01)

(56) References Cited

U.S. PATENT DOCUMENTS

| | | | | |
|---|---|---|---|---|
| 2011/0122188 | A1* | 5/2011 | Mitsunaga ..... | B41J 11/006<br>347/16 |
| 2011/0128557 | A1 | 6/2011 | Kinoshita | |
| 2014/0168309 | A1 | 6/2014 | Morita | |
| 2015/0174916 | A1 | 6/2015 | Hara | |

FOREIGN PATENT DOCUMENTS

| | | | |
|---|---|---|---|
| JP | H07-081050 | A | 3/1995 |
| JP | H09-300658 | A | 11/1997 |
| JP | 2013-13711 | A | 1/2013 |
| WO | 2009025371 | A1 | 2/2009 |
| WO | 2014013974 | A1 | 1/2014 |

* cited by examiner

TABLET PRINTING APPARATUS AND TABLET PRINTING METHOD

TECHNICAL FIELD

The present invention relates to a tablet printing apparatus that prints characters, marks, pictures and the like on a surface of a tablet, and a tablet printing method.

BACKGROUND ART

Heretofore, a solid preparation printing apparatus (tablet printing apparatus) described in Patent Literature 1 has been known. In the solid preparation printing apparatus, a printing mechanism that performs printing (transfer) by a transfer roller prints characters, marks and the like on surfaces of solid preparations (tablets) sequentially conveyed by a conveyor (conveyor belt). In the conveyor, pockets having a minute hole are arranged in the conveying direction thereof, and the solid preparations are sequentially conveyed by the conveyor moved with the solid preparations accommodated in the pockets. Then, an air suction part that sucks in air through the minute hole of each pocket is provided on the rear side of a part of the conveyor opposite to the transfer roller. The solid preparation, which is taken in each of the part opposite to the transfer roller of the conveyer, is certainly held in the pocket by air suctioning action of the air suction part. This enables the transfer roller to accurately transfer (print) characters, marks and the like without a printing misalignment on the solid preparation held in each pocket. In such a solid preparation printing apparatus, the characters, marks and the like to be printed are changed by replacing the transfer roller with a desired transfer roller to print.

CITATION LIST

Patent Literature

Patent Literature 1: Japanese Patent Laid-Open No. 6-143539

SUMMARY OF INVENTION

Technical Problem

A tablet printing apparatus such as the aforementioned conventional solid preparation printing apparatus that prints on a tablet such as a solid preparation may adopt, instead of the printing mechanism using the transfer roller, an inkjet printing mechanism (so-called inkjet printer) that has an inkjet head including multiple nozzles that eject ink drops, and prints by ejecting ink drops from the multiple nozzles in the inkjet head according to a pattern based on print data. Adoption of such an inkjet printing mechanism is advantageous in that it can immediately deal with a change in the characters or marks to be printed, due to switching of the tablet type, by changing print data to be provided. In addition, when the tablet as the print target is to be taken from the mouth, printing by the inkjet printing mechanism is sanitary since the tablet can be printed without contact.

However, sometimes a tablet does not arrive at a print position when the tablet is caught in the middle of conveying, or when there is shortage of tablets to be fed onto the conveyor belt, for example. In this case, the nozzle is left without ejecting ink drops for a long time. Since air is sucked in at the print position of the conveyor belt (conveyor), air is stirred around the nozzle tips of the inkjet head facing the print position, and the stirred air may dry the ink on the nozzle tips. Although the ink on the nozzle tip is less likely to dry and hinder ejection when ink drops are ejected at short intervals, the ink on the nozzle tip is more likely to dry when the duration of no ejection becomes longer. Such drying of the ink on the nozzle tip hinders ejection of ink drops from the nozzle tip upon restart of tablet conveyance, and thereby hinders normal printing on the tablet in the print position.

The present invention has been made in view of the foregoing, and provides a tablet printing apparatus and a tablet printing method that can prevent drying of ink on nozzle tips of an inkjet printing mechanism, when a tablet does not arrive at a print position.

Solution to Problem

A tablet printing apparatus of the present invention includes: a conveyor mechanism that conveys sequentially fed tablets by moving a conveyor belt; a printing mechanism that has an inkjet head including a plurality of nozzles ejecting ink drops, the inkjet head being arranged face to a surface of the conveyor belt, and performs printing on a tablet in a print position on the conveyor belt by ejecting ink drops from the multiple nozzles onto the tablet according to print data; a suction mechanism that holds a tablet on the surface of the conveyor belt in a predetermined area including at least the print position by sucking in air; a determination unit that determines whether a tablet arrives at the print position on the basis of a preset reference; and a head retreat unit that retreats the inkjet head such that a tip end part of each of the plurality of nozzles goes away from the surface of the conveyor belt, when the determination unit determines that a tablet does not arrive at the print position.

The tablet printing apparatus of the present invention includes: a conveyor mechanism that conveys sequentially fed tablets by moving a conveyor belt; a printing mechanism that has an inkjet head including a plurality of nozzles ejecting ink drops, the inkjet head being arranged face to a surface of the conveyor belt, and performs printing on a tablet in a print position on the conveyor belt by ejecting ink drops from the multiple nozzles onto the tablet according to print data; a suction mechanism that holds a tablet on the surface of the conveyor belt in a predetermined area including at least the print position by sucking in air; a determination unit that determines whether a tablet arrives at the print position on the basis of a preset reference; and an airstream shutoff member that is inserted between tip end parts of the plurality of nozzles and the conveyor belt, when the determination unit determines that a tablet does not arrive at the print position.

A tablet printing method of the present invention uses a conveyor mechanism that conveys sequentially fed tablets by moving a conveyor belt, a printing mechanism that has an inkjet head including a plurality of nozzles ejecting ink drops, the inkjet head being arranged to face to a surface of the conveyor belt, and performs printing on a tablet in the print position on the conveyor belt by ejecting ink drops from the plurality of nozzles onto the tablet according to print data, and a suction mechanism that holds a tablet on the surface of the conveyor belt in a predetermined area including at least the print position by sucking in air, and includes a determination step of determining whether a tablet arrives at a print position on the basis of a preset reference; and a head retreat step of retreating the inkjet head such that a tip end part of each of the multiple nozzles goes away from the surface of the conveyor belt, when it is determined in the determination step that a tablet does not arrive at the print position.

A tablet printing method of the present invention uses a conveyor mechanism that conveys sequentially fed tablets by moving a conveyor belt, a printing mechanism that has an inkjet head including a plurality of nozzles ejecting ink drops, the inkjet head being arranged to face to a surface of the conveyor belt, and performs printing on a tablet in the print position on the conveyor belt by ejecting ink drops from the plurality of nozzles onto the tablet according to print data, and a suction mechanism that holds a tablet on the surface of the conveyor belt in a predetermined area including at least the print position by sucking in air, and includes a determination step of determining whether a tablet arrives at a print position on the basis of a preset reference; and an airstream shutoff step of shutting off an airstream between tip end parts of the multiple nozzles and the conveyor belt, when it is determined in the determination step that a tablet does not arrive at the print position.

Advantageous Effect of Invention

According to the present invention, tablets sequentially conveyed with movement of a conveyor belt are printed by ink drops ejected from multiple nozzles in an inkjet head of a printing mechanism according to print data, while being held to the conveyor belt in a print position by an air suction effect of a suction mechanism. In the process, if it is determined that a tablet does not arrive at the print position on the basis of a preset reference, the inkjet head is retreated such that each of tip end parts of the multiple nozzles goes away from the surface of the conveyor belt, or an airstream shutoff member is inserted between the tip end parts of the multiple nozzles and the conveyor belt. Hence, the tip end parts of the nozzles are less likely to be affected by the air suction effect of the suction mechanism when the tablet does not arrive at the print position, and drying of ink on the tip end of the nozzles of the printing mechanism can be prevented.

DESCRIPTION OF EMBODIMENT

Hereinafter, an embodiment of the present invention will be described with reference to the drawings.

A tablet as a print target of the present invention is described by using a tablet Tb as an example, but a tablet includes pills and tablets such as a non-coated tablet (uncoated tablet), a sugar-coated tablet, a film-coated tablet, an enteric coated tablet, a gelatin-coated tablet, a multilayered tablet, and a dry coated tablet, may also include capsules such as a hard capsule and a soft capsule and other similar small solids, and may be used for any purpose such as medicine, food, detergent, and industrial use.

Figure 1:
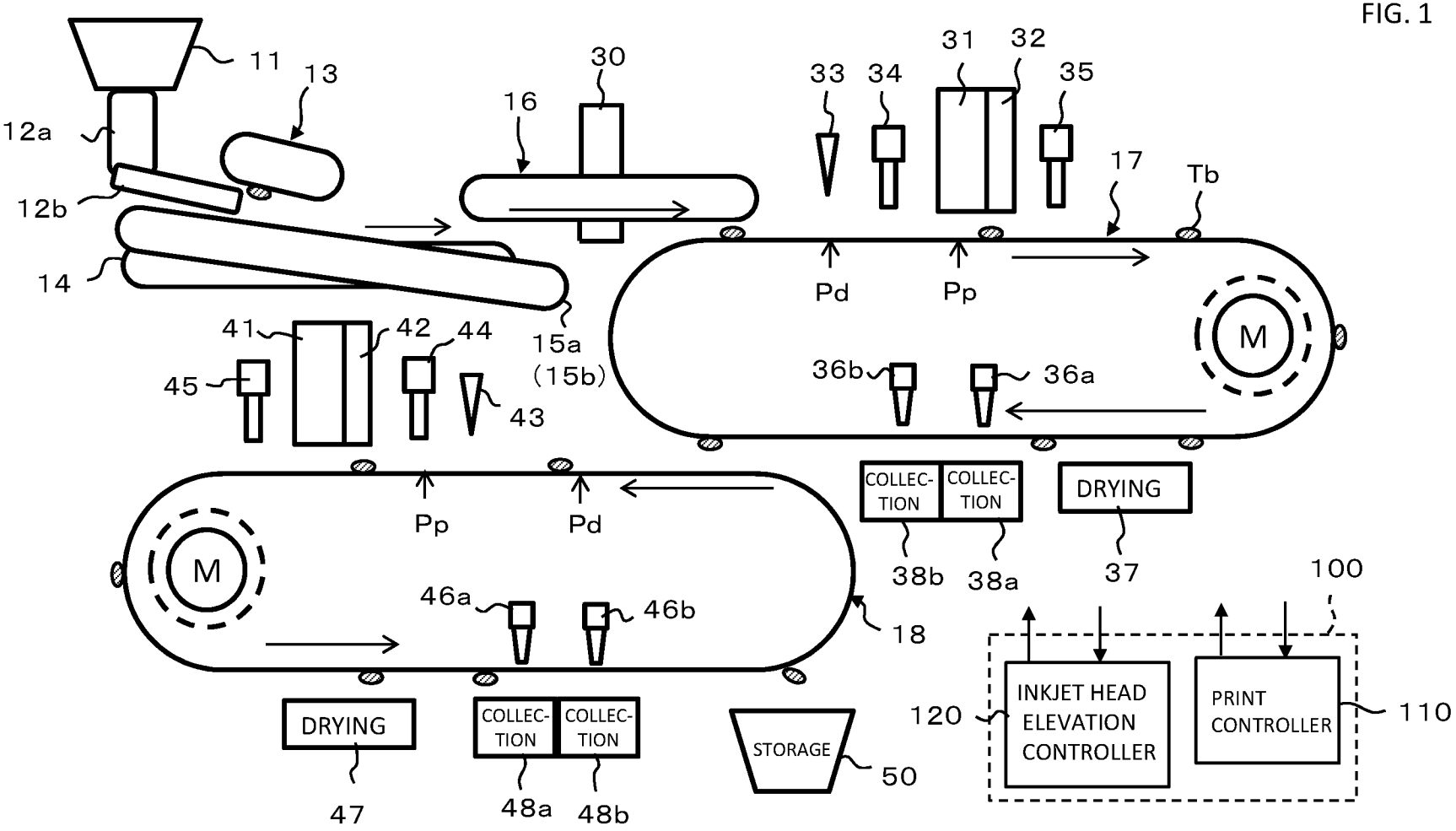
FIG. 1 is a diagram schematically showing an overall configuration of a tablet printing apparatus of an embodiment of the present invention.

A tablet printing apparatus of an embodiment of the present invention is configured as in FIG. 1. In FIG. 1, a hopper 11 that stores tablets as a print target is connected to a first vibrating feeder 12*a* and a second vibrating feeder 12*b*, and the second vibrating feeder 12*b* is connected to a first transfer feeder 13 and an alignment feeder 14. A first conveyor mechanism 17 is arranged behind the alignment feeder 14, and a second transfer feeder 16 is arranged such that it covers, from above, a rear end part of the alignment feeder 14 and a front end part of the first conveyor mechanism 17. A second conveyor mechanism 18 is arranged below the first conveyor mechanism 17 such that end parts overlap each other in the vertical direction. As shown not only in FIG. 1 but also in FIG. 2, return feeders 15*a*, 15*b* are arranged on both sides of the alignment feeder 14.

Figure 2:
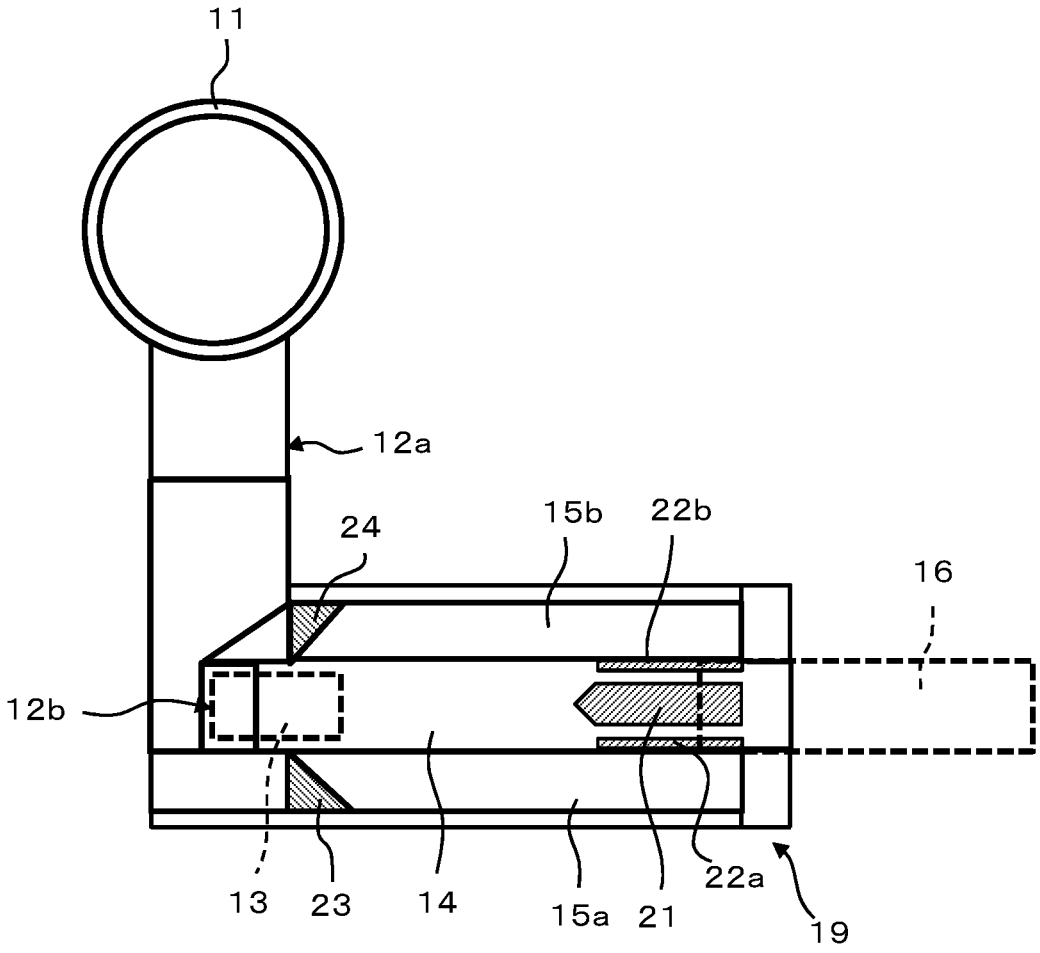
FIG. 2 is a plan view showing a hopper, a first vibrating feeder, a second vibrating feeder, a first transfer feeder, an alignment feeder, a second transfer feeder, and two return feeders of the tablet printing apparatus shown in FIG. 1.
Figure 3:
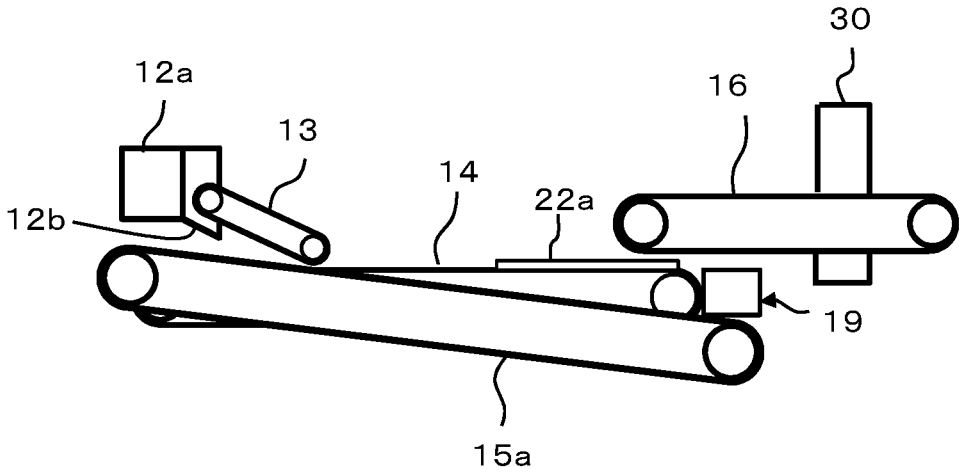
FIG. 3 is a side view showing the first vibrating feeder, the second vibrating feeder, the first transfer feeder, the alignment feeder, the second transfer feeder, and the return feeder of the tablet printing apparatus shown in FIG. 1.

Each of the first vibrating feeder 12*a* and the second vibrating feeder 12*b* is configured as a trough-like conveyor path provided with a vibrator, and the tablets Tb sequentially fed from the hopper 11 are sequentially moved toward the alignment feeder 14 through the conveyor path by the vibration. The alignment feeder 14 is configured as a conveyor belt wound around two pulleys, and as shown in FIG. 2, a sorting guide 21 is arranged in a center part in the width direction on an end part of the conveyor belt on the second transfer feeder 16 side, while two alignment guides 22*a*, 22*b* sandwiching the sorting guide 21 are arranged to form, with the sorting guide 21, gaps large enough to allow passage of the tablets Tb. As in the case of the alignment feeder 14, each of the return feeders 15*a*, 15*b* arranged on both sides of the alignment feeder 14 is configured as a conveyor belt wound around two pulleys as shown in FIG. 3, and the moving direction (conveying direction) of the conveyor belt is set opposite to the moving direction (conveying direction) of the conveyor belt of the alignment feeder 14. The return feeders 15*a*, 15*b* are each inclined in such a manner as to move upward from the downstream side to the upstream side of the alignment feeder 14, and as shown in FIG. 2, are respectively provided with return guides 23, 24 that guide the tablets Tb conveyed to a predetermined position on the downstream side of the conveying direction to the alignment feeder 14. A guide unit 19 that guides the tablet Tb to the return feeders 15*a*, 15*b* is provided adjacent to a downstream end part of the alignment feeder 14.

Figure 4:
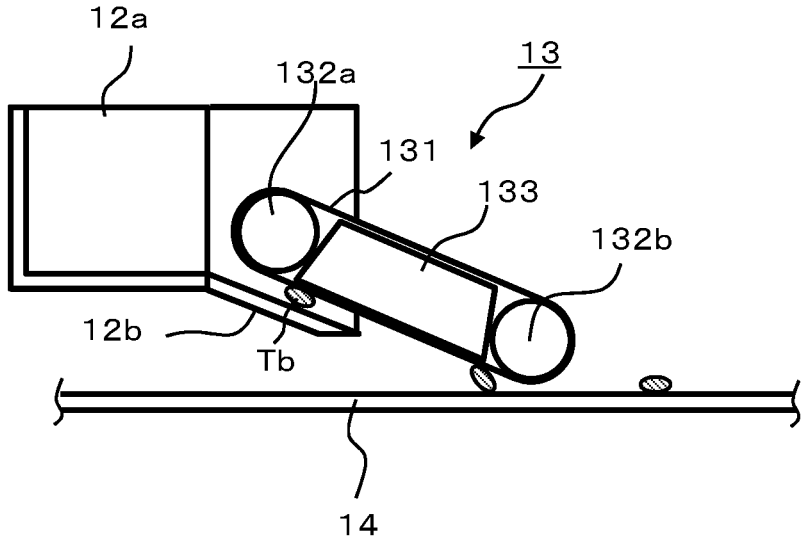
FIG. 4 is a diagram showing a detailed configuration of the first transfer feeder.

The first transfer feeder 13, which is arranged such that it covers the second vibrating feeder 12*b* and an upstream end part of the alignment feeder 14 as shown not only in FIG. 2 but also in FIG. 3, is configured as a conveyor belt 131 wound around two pulleys 132*a*, 132*b*, as shown in FIG. 4. The conveyor belt 131 is gas permeable by having micropores formed with a predetermined density, or being formed of a mesh-like sheet material. A suction chamber 133 coupled with a suction device (not shown) such as a vacuum pump is provided inside the conveyor belt 131. A suction face of the suction chamber 133 faces the side of the second vibrating feeder 12*b* and the alignment feeder 14, that is, the lower side, and the suction effect of the suction chamber 133 based on the operation of the suction device adsorbs and holds the tablet Tb sent out from the second vibrating feeder 12*b* to the conveyor belt 131. The tablet Tb is conveyed by movement of the conveyor belt 131 caused by rotation of the two pulleys 132*a*, 132*b*. The tablet Tb then drops from the conveyor belt 131 onto the conveyor belt of the alignment feeder 14, at a point where the suction effect of the suction chamber 133 no longer works. Since the tablet Tb is thus fed to the alignment feeder 14 from the second vibrating feeder 12*b* through the first transfer feeder 13, vibration from dropping of the tablet Tb can be prevented, and the tablet Tb can be transferred to the alignment feeder 14 in a stable position, as compared to feeding the tablet Tb directly to the alignment feeder 14 from the second vibrating feeder 12*b*.

As in the case of the aforementioned first transfer feeder 13, the second transfer feeder 16 is configured as a gas permeable conveyor belt wound around two pulleys, and a suction chamber (not shown) coupled with a suction device (not shown) is provided inside the conveyor belt. The second transfer feeder 16 receives the tablet Tb from the alignment feeder 14 by the suction effect of the suction chamber, conveys the tablet Tb, and transfers it to the first conveyor mechanism 17 at a point where the suction effect of the suction chamber no longer works. An elevating mechanism 30 is provided to the second transfer feeder 16. The elevating mechanism 30 can raise and lower the second transfer feeder 16 between a normal position where it can receive the tablet Tb from the alignment feeder 14, and a predetermined retreat position where it cannot receive the tablet from the alignment feeder 14.

Figure 5A:
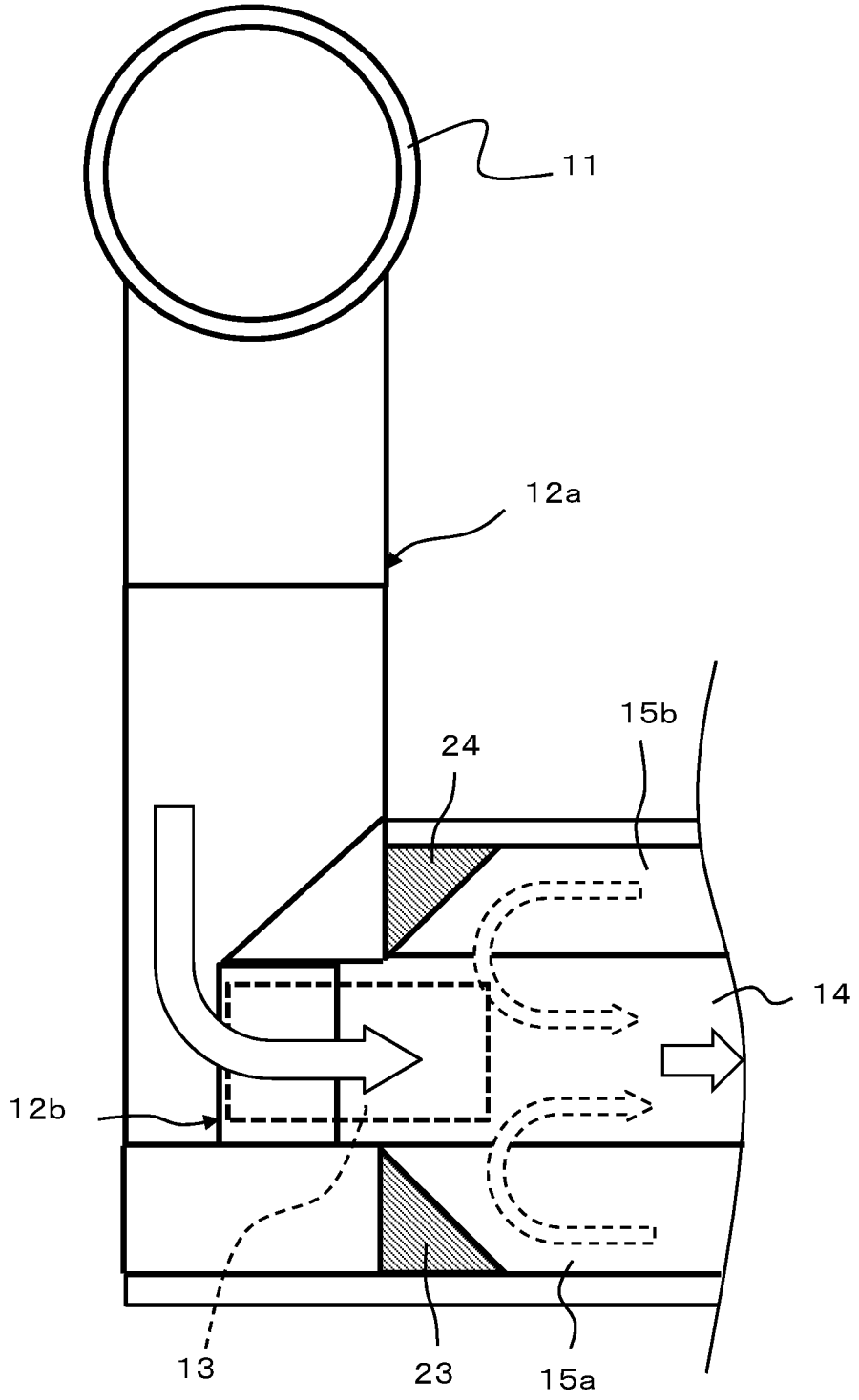
FIG. 5A is a diagram showing a (first) flow of tablets as a print target.

In the tablet printing apparatus configured in the above-mentioned manner, the tablets Tb fed from the hopper 11 and sequentially moving through the first vibrating feeder 12*a* and the second vibrating feeder 12*b* are conveyed from the second vibrating feeder 12*b* to the alignment feeder 14 through the first transfer feeder 13, as indicated by solid line-wide arrows in FIG. 5A. Then, as indicated by a solid line-wide arrow in FIG. 5B, the tablets Tb sequentially conveyed by the alignment feeder 14 are sorted into two directions by the sorting guide 21 to form two rows, which are a row passing through a gap between the sorting guide 21 and the alignment guide 22*a* and a row passing through a gap between the sorting guide 21 and the alignment guide 22*b*, and are sequentially received by the second transfer feeder 16. Then, the tablets Tb are transferred in two rows from the second transfer feeder 16 to the first conveyor mechanism 17.

Figure 5B:
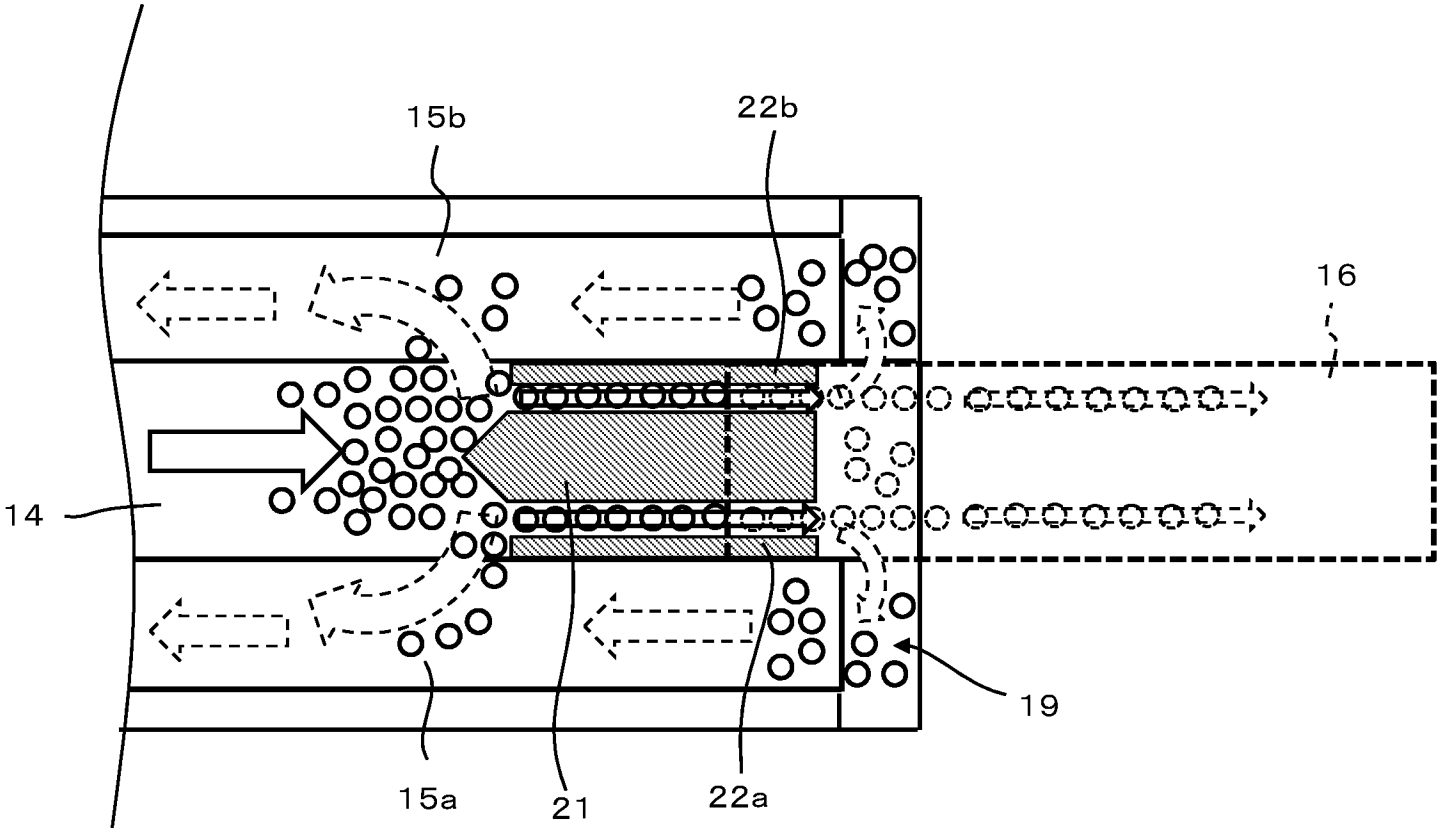
FIG. 5B is a diagram showing a (second) flow of the tablets as a print target.

Also, as indicated by broken line-wide arrows in FIG. 5B, the tablets Tb having fallen from the alignment feeder 14 after hitting the sorting guide 21 and the alignment guides 22*a*, 22*b*, for example, are received by the return feeders 15*a*, 15*b*, while the tablets Tb formed into two rows by the sorting guide 21 and the alignment guides 22*a*, 22*b* but not received by the second transfer feeder 16 are guided to the return feeders 15*a*, 15*b* by the guide unit 19. Then, the tablets Tb received and returned by the return feeders 15*a*, 15*b* are guided to the upstream tip end in the moving direction of the alignment feeder 14 by the return guides 23, 24, as indicated by broken line-wide arrows in FIG. 5A. Thus, the tablets Tb fed from the hopper 11 and sequentially moving through the first vibrating feeder 12*a* and the second vibrating feeder 12*b* are conveyed by the alignment feeder 14 while being returned to the alignment feeder 14 by the return feeders 15*a*, 15*b* and sorted into two rows by the sorting guide 21 and the two alignment guides 22*a*, 22*b* in this process, and are received by the second transfer feeder 16 from the alignment feeder 14. Although tip end parts of the alignment guides 22*a*, 22*b* provided in the aforementioned alignment feeder 14 are formed into a square shape in Figure, the tip end shape may be curved or formed into a triangular shape as in the case of the sorting guide 21. This makes it easier to give direction to the flow of tablets Tb and facilitate sorting. Additionally, this suppresses impact on the tablets, so that chipping can be avoided.

Figure 6:
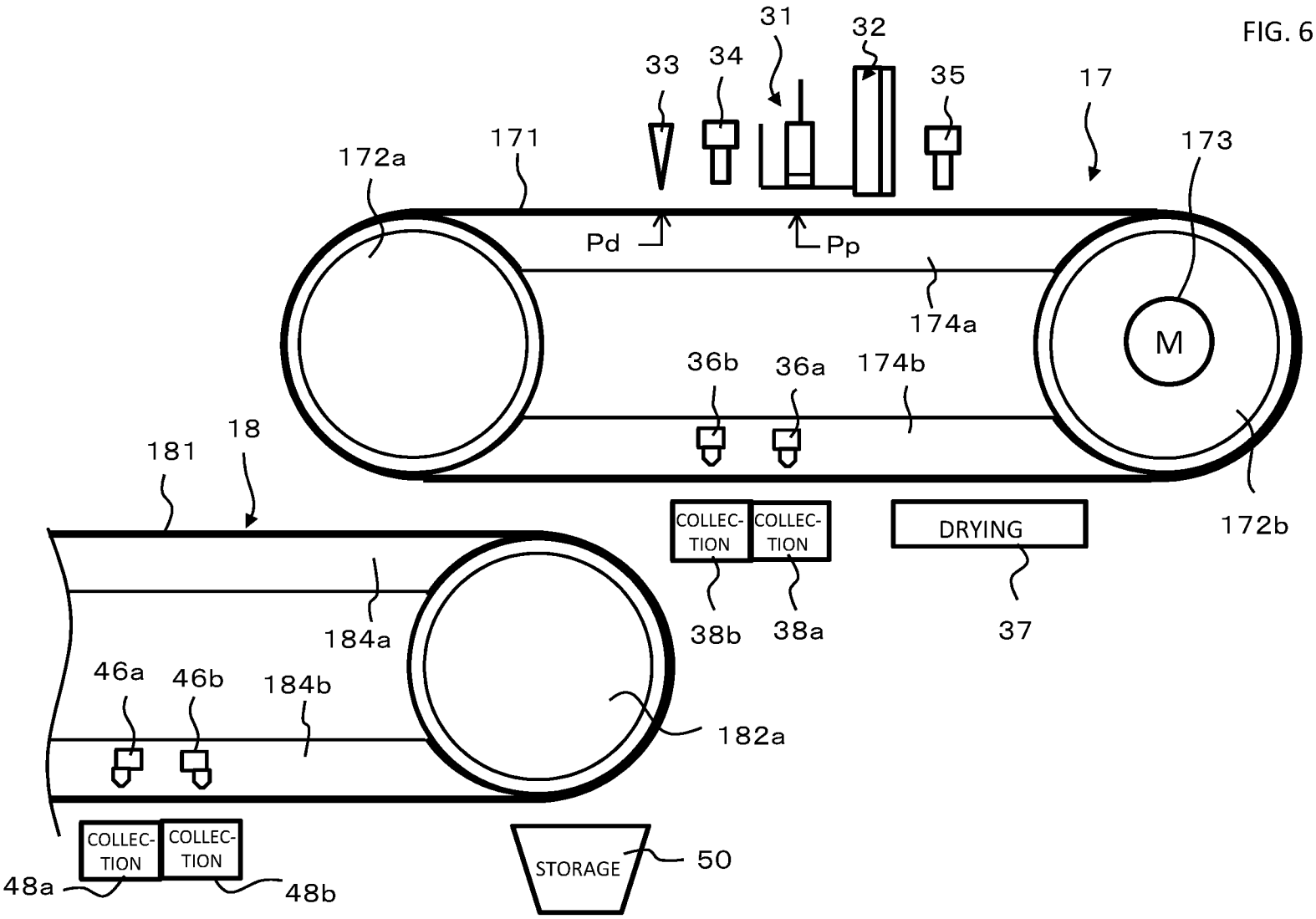
FIG. 6 is a diagram showing a configuration of a first conveyor mechanism, components arranged relative thereto, and a part of a second conveyor mechanism of the tablet printing apparatus shown in FIG. 1.

As shown in FIG. 6, the first conveyor mechanism 17 is configured as a conveyor belt 171 wound around two pulleys 172*a*, 172*b*. As in the cases of the first transfer feeder 13 and the second delivery feeder 16, the conveyor belt 171 is gas permeable. One pulley 172*b* is a drive pulley that rotates by a motor M, and the other pulley 172*a* is a driven pulley. Rotation of the pulley 172*b* caused by driving of the motor M rotates the annular conveyor belt 171. The motor M is provided with an encoder 173 that operates along with rotation of a drive shaft of the motor M. Two suction chambers 174*a*, 174*b* (suction mechanism) arranged on upper and lower sides are provided inside the annular conveyor belt 171. Each of the suction chambers 174*a*, 174*b* is coupled with an unillustrated suction device such as a vacuum pump, sucks in air from a rear face side of a part of the conveyor belt 171 opposite thereto by the suction effect of the suction device, and adsorbs and holds the tablet Tb on a front face of the conveyor belt 171 by the suction effect. A groove (not shown) is formed on the entire periphery of the pulley 172*b* which is a drive pulley. Each of the suction chambers 174*a*, 174*b* fits into the groove on the pulley 172*b*, and sucks in air from a rear face side of a part of the conveyor belt 171 wound around the pulley 172*b*, to adsorb and hold the tablet Tb on the a front face of this part.

The tablet printing apparatus adopts an inkjet printing mechanism (so-called inkjet printer) that has an inkjet head including multiple nozzles that eject ink drops, and drives energy generating elements such as piezoelectric elements and thermal elements according to print data, to print by ejecting ink drops from the nozzles. As shown not only in FIG. 1 but also in FIG. 6, the conveyor belt 171 of the first conveyor mechanism 17 is surrounded by a first inkjet head 31 of the inkjet printing mechanism, a first tablet sensor 33 configured of a reflective optical sensor, for example, a first posture check camera 34 and a first print check camera 35 formed of an imaging device including a CCD or the like, a first drying unit 37 such as a plane heater, and two collection trays 38*a*, 38*b*. Two air injection nozzles 36*a*, 36*b* are provided in the lower suction chamber 174*b*, and the two air injection nozzles 36*a*, 36*b* and the two collection trays 38*a*, 38*b* are arranged opposite to each other with the conveyor belt 171 interposed therebetween. An elevating mechanism 32 (an inkjet head moving mechanism/a head retreat unit) that moves the first inkjet head 31 up and down is also provided. The elevating mechanism 32 raises and lowers the inkjet head 31 between a normal position (e.g., 5 mm above surface of conveyor belt 171) where printing is performed on the tablet Tb on the conveyor belt 171 in a direction perpendicular to the surface of the conveyor belt 171, and a retreat, position (e.g., 15 mm above surface of conveyor belt 171) farther away from the surface of the conveyor belt 171 than the normal position.

In the elevating mechanism 32 as an inkjet head moving mechanism, a bracket to which the first inkjet head 31 is attached is mounted on a linear guide for guiding in a direction perpendicular to the surface of the conveyor belt 171, for example. Rising and lowering of the bracket, which is caused by rotation of a ball screw driven by a rotation motor, raises and lowers the first inkjet head 31.

As described earlier, the tablets Tb are sorted into two rows and transferred from the second transfer feeder 16 to the first conveyor mechanism 17 (see FIG. 5B). Hence, actually, to deal with the two rows of the tablets Tb on the conveyor belt 171, there are two sets of the aforementioned first inkjet head 31, first tablet sensor 33, first posture check camera 34, first print check camera 35, first drying unit 37, two air injection nozzles 36*a*, 36*b*, and two collection trays 38*a*, 38*b* to correspond to the two rows of the tablets Tb. Since the two sets perform the same operation, only one set will be described below.

Note that even if there is only one set of all or some of the aforementioned first inkjet head 31, first tablet sensor 33, first posture check camera 34, first print check camera 35, first drying unit 37, two air injection nozzles 36*a*, 36*b*, and two collection trays 38*a*, 38*b*, the mechanism may be configured to respectively print on the two rows of tablets Tb.

The first inkjet head 31 (multiple nozzles) faces the surface of the conveyor belt 171 in a print position Pp set within an area where air is sucked in by the suction chamber 174*a*. The first tablet sensor 33 outputs a detection signal, based on presence or absence of a tablet on the conveyor belt 171 in a tablet detection position Pd, which is set on the upstream side of the print position Pp in a moving direction of the conveyor belt 171. A shooting area of the first posture check camera 34 includes a predetermined area between the print position Pp and the tablet detection position Pd on the conveyor belt 171. A shooting area of the first print check camera 35 is set to a predetermined area on the downstream side of the first inkjet head 31 in the moving direction of the conveyor belt 171. The first drying unit 37 is arranged so that it faces a relatively upstream part of the conveyor belt 171 facing the lower suction chamber 174*b*. The two air injection nozzles 36*a*, 36*b* and the two collection trays 38*a*, 38*b* are arranged in such a manner as to sandwich a relatively downstream part of the conveyor belt 171 facing the lower suction chamber 174*b*.

Referring back to FIGS. 1 and 6, the second conveyor mechanism 18 has substantially the same configuration as the aforementioned first conveyor mechanism 17. Specifically, the second conveyor mechanism 18 is configured as a gas permeable conveyor belt 181 wound around two pulleys 182*a* (182*b*: omitted in illustration), two suction chambers 184*a*, 184*b* arranged on upper and lower sides and coupled to a suction device such as a vacuum pump are provided inside the conveyor belt 181, and the conveyor belt 181 is surrounded by a second inkjet head 41 of the inkjet printing mechanism, a second elevating mechanism 42 (inkjet head moving mechanism), a second tablet sensor 43, a second posture check camera 44, a second print check camera 45, a second drying unit 47, and two collection trays 48*a*, 48*b*. Two air injection nozzles 46*a*, 46*b* are provided in the lower suction chamber 184*b*, and the two air injection nozzles 46*a*, 46*b* and the two collection trays 48*a*, 48*b* are arranged opposite to each other with the conveyor belt 181 interposed therebetween. Particularly, in the second conveyor mechanism 18, a storage tray 50 is arranged in such a manner as to face a part at the end of the stream in the moving direction of the conveyor belt 181.

In the tablet printing apparatus configured in the above-mentioned manner, characters and marks are sequentially printed on the surface of the tablets Tb under control of a print controller 110 included in a controller 100, in the following manner.

As described earlier, the tablets Tb sequentially fed from the hopper 11 and moving through the first vibrating feeder 12*a* and the second vibrating feeder 12*b* are transferred to the alignment feeder 14 (see FIGS. 4 and 5A) by the first transfer feeder 13. Then, the tablets Tb sorted into two rows (see FIG. 5B) by the alignment feeder 14 are sequentially transferred to the first conveyor mechanism 17 by the second transfer feeder 16. The tablets Tb sequentially transferred from the alignment feeder 14 to the first conveyor mechanism 17 by the second transfer feeder 16 are sequentially conveyed in two rows while being adsorbed and held to the conveyor belt 171.

When the tablet Tb (in tablet detection position Pd) is detected based on a detection signal from the first tablet sensor 33 during conveyance of the tablets Tb in each row, from this point forward, a position of the detected tablet Tb relative to the tablet detection position Pd is recognized by the print controller 110, on the basis of a value of the encoder 173. Then, when the tablet Tb enters the shooting area of the first posture check camera 34, it is determined, based on an image taken by the first posture camera 34, whether the tablet Tb includes damage such as chipping. Furthermore, a posture (including front or back side of tablet Tb, position on belt, and posture such as orientation and tilt in vertical direction of tablet Tb held on belt) on the surface of the conveyor belt 171 of the tablet Tb determined not to include damage is determined. Thereafter, when the tablet Tb determined not to include damage passes the print position Pp, an ink drop ejection pattern from the multiple nozzles of the first inkjet head 31 is controlled according to the detected orientation and print data, whereby characters, marks and the like are printed in a normal orientation in a normal position on a surface of the tablet Tb. On the other hand, printing is not performed on the tablet Tb determined to include damage. Thereafter, the print controller 110 tracks the position (based on value of encoder 173) of the unprinted tablet Tb.

When the printed tablet Tb enters the shooting area of the first print check camera 35, it is determined, based on an image taken by the first print check camera 35, whether characters and marks are normally printed on the tablet Tb. Thereafter, the print controller 110 tracks the position (based on value of encoder 173) of the tablet Tb determined not to have been printed normally.

The tablet Tb on which printing has been completed and having passed the shooting area of the first print check camera 35 is conveyed with movement of the conveyor belt 171, and undergoes drying (fixing) of ink of the characters and marks printed on the surface thereof while being conveyed facing to the first drying unit 37. On the other hand, when the tablet Tb that has not been printed due to damage such as chipping and whose position is tracked by the print controller 110 arrives at a position facing to one air injection nozzle 36*a*, the tablet Tb is blown off the surface of the conveyor belt 171 by air injected from the air injection nozzle 36*a*, and is collected in the collection tray 38*a*. Additionally, when the tablet Tb that has not been printed normally even though it does not include damage such as chipping and whose position is tracked by the print controller 110 arrives at a position facing to the other air injection nozzle 36*b*, the tablet Tb is blown off the surface of the conveyor belt 171 by air injected from the air injection nozzle 36*b*, and is collected in the other collection tray 38*b*.

The tablet Tb that has characters and marks normally printed on its surface is conveyed with movement of the conveyor belt 171, and drops from the conveyor belt 171 onto the conveyor belt 181 of the second conveyor mechanism 18 at a point where the suction effect of the lower suction chamber 174*b* no longer works. Thus, the tablet Tb that has print performed normally on its surface is transferred from the first conveyor mechanism 17 to the second conveyor mechanism 18.

The tablet Tb transferred to the second conveyor mechanism 18 is placed on the conveyor belt 181 with the already printed face facing downward, and is conveyed while being adsorbed and held to the moving conveyor belt 181. The tablet Tb conveyed with movement of the conveyor belt 181 undergoes printing of characters, marks and the like by ink drops ejected according to print data from multiple nozzles of the second inkjet head 41, in the same process as the printing performed during conveyance by the first conveyor mechanism 17. Specifically, as in the case of the processing of the first conveyor mechanism 17, the tablet Tb is detected based on a detection signal from the second tablet sensor 43, and when the tablet Tb enters the shooting area of the second position check camera 44, it is determined, based on an image taken by the second position camera 44, whether the tablet Tb includes damage such as chipping. Furthermore, a posture (including front or back side of tablet Tb, position on belt, and postures such as orientation and tilt in vertical direction of tablet Tb held on belt) on the surface of the conveyor belt 181 of the tablet Tb determined not to include damage is determined. At this time, data such as the orientation detected in the first conveyor mechanism 17 and print data may be used. Thereafter, when the tablet Tb determined not to include damage passes the print position Pp, an ink drop ejection pattern from the multiple nozzles of the second inkjet head 41 is controlled according to the detected orientation and print data, whereby characters, marks and the like are printed in a normal orientation in a normal position on a surface of the tablet Tb. On the other hand, printing is not performed on the tablet Tb determined to include damage. As in the processing of the first conveyor mechanism 17, the position of the unprinted tablet Tb is tracked. When the printed tablet Tb enters the shooting area of the second print check camera 45, it is determined, based on an image taken by the second print check camera 45, whether characters and marks are normally printed on the tablet Tb. Then, the position of the tablet Tb determined not to have been printed normally is tracked. The printed tablet Tb undergoes drying of ink by the second drying unit 47, and is dropped and accommodated in the storage tray 50 at a point where the suction effect of the lower suction chamber 184*b* no longer works. On the other hand, the unprinted tablet Tb is blown off the conveyor belt 181 by air injected from the air injection nozzle 46*a* and collected in the collection tray 48*a*, and the tablet Tb that has not been printed normally is blown off the conveyor belt 181 by air injected from the air injection nozzle 46*b* and collected in the collection tray 48*b*.

As has been described, characters and marks are printed on both sides of each tablet Tb during conveyance by the first conveyor mechanism 17 and the second conveyor mechanism 18.

Figure 7:
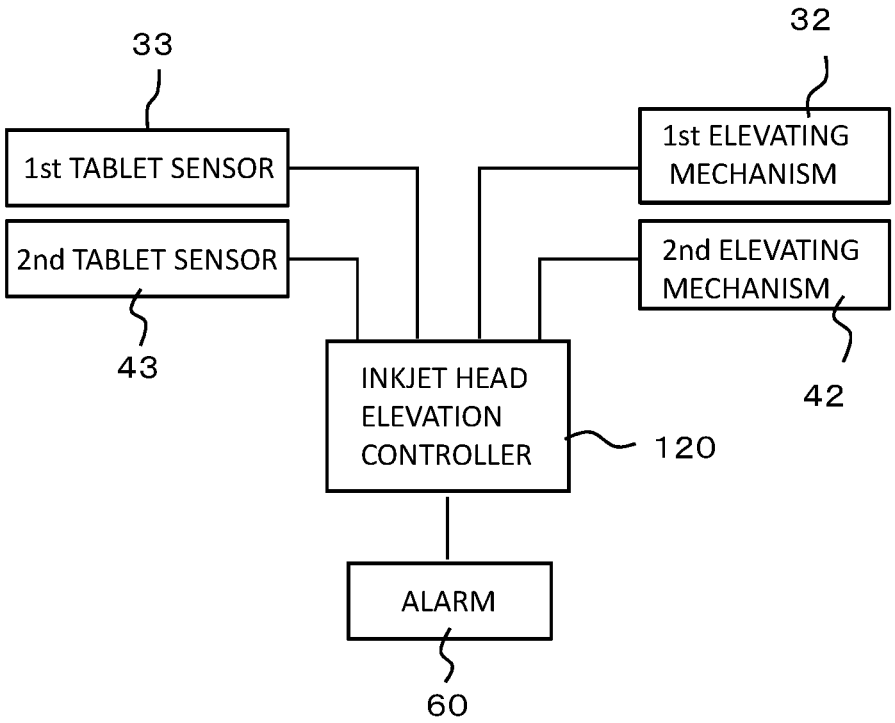
FIG. 7 is a block diagram showing a basic configuration of a control system that controls raising and lowering operations of an inkjet head.

The controller 100 provided in the tablet printing apparatus has an inkjet head elevation controller 120, in addition to the aforementioned print controller 110. Note that the controller 100 performs centralized control of the tablet printing apparatus including control of parts such as the vibrating feeders 12*a*, 12*b*, the alignment feeder 14, the transfer feeders 13, 16, the return feeders 15*a*, 15*b*, and the drying units, for example, in addition to the aforementioned control by the print controller 110 and later mentioned control by the inkjet head elevation controller 120. As shown in FIG. 7, the inkjet head elevation controller 120 receives detection signals from the first tablet sensor 33 and the second tablet sensor 43, and controls the first elevating mechanism 32 that raises and lowers the first inkjet head 31 between the normal position and the retreat position, the second elevation mechanism 42 that raises and lowers the second inkjet head 41 between the normal position and the retreat position, and an alarm 60. The inkjet head elevation controller 120 controls the first elevating mechanism 32 and the second elevating mechanism 42 according to a procedure shown in FIGS. 8A and 8B. Note that since the control procedures of the first elevating mechanism 32 and the second elevating mechanism 42 are the same, the following description will be given of control of the first elevating mechanism 32.

Figure 8A:
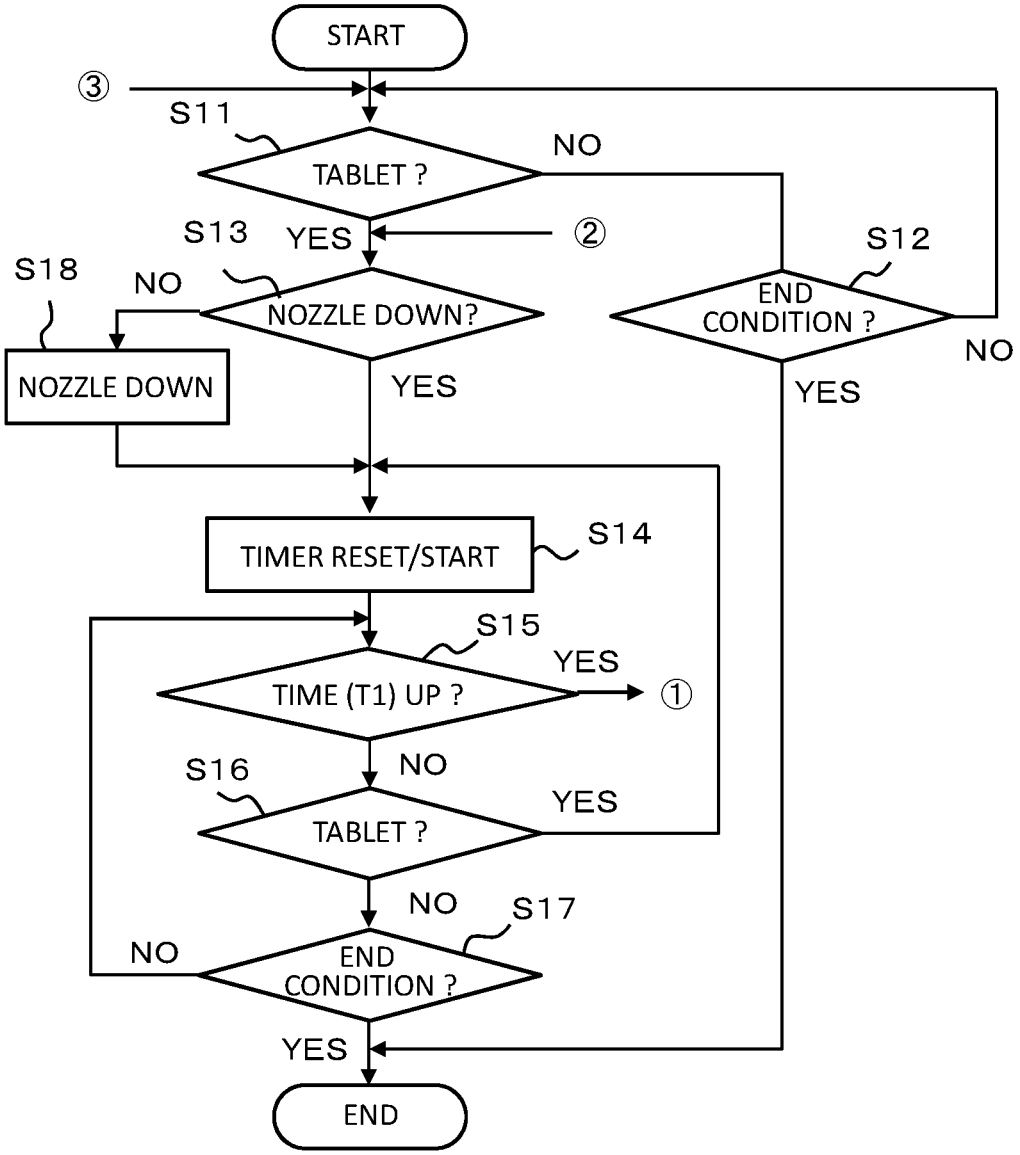
FIG. 8A is a flowchart showing a (first) procedure of processing of raising and lowering operations of the inkjet head.
Figure 8B:
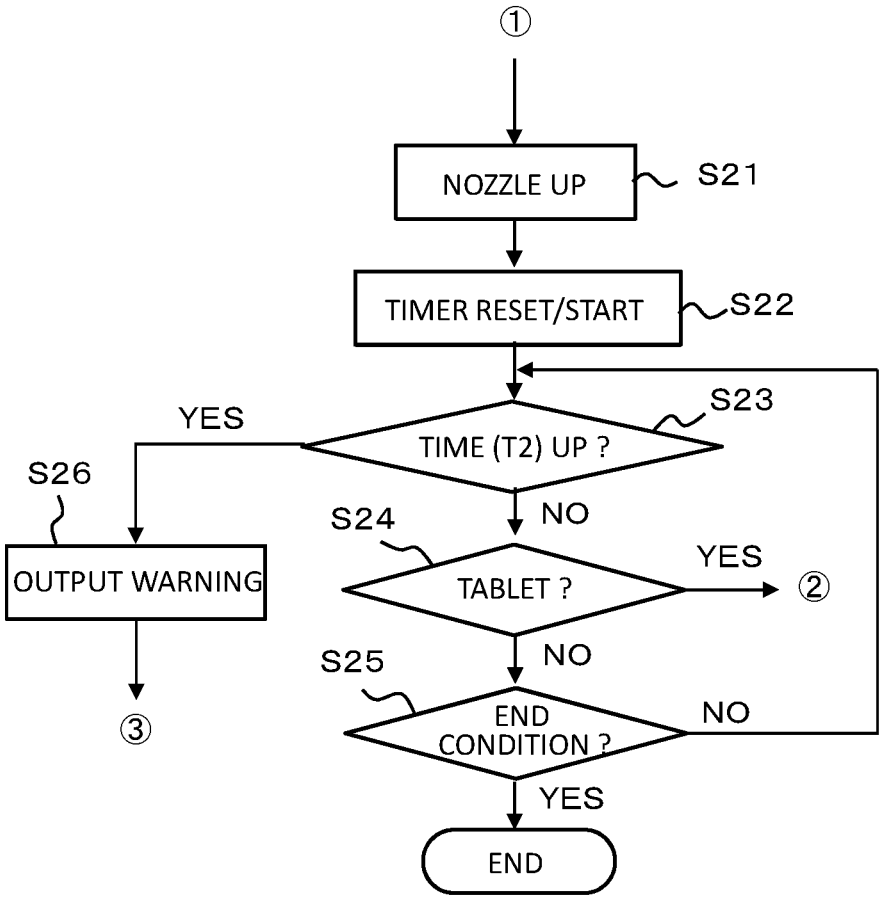
FIG. 8B is a flowchart showing a (second) procedure of processing of raising and lowering operations of the inkjet head.

In FIG. 8A, the inkjet head elevation controller 120 determines whether an end condition (e.g., whether an end operation has been performed) is met (S12), while also determining whether the tablet Tb is in the tablet detection position Pd on the basis of a detection signal from the first tablet sensor 33 (detector) (S11). If the conveyed tablet Tb arrives at the tablet detection position Pd in this process and it is determined that the tablet Tb is in the tablet detection position Pd (YES in S11), the inkjet head elevation controller 120 confirms (YES in S13) that the first inkjet head 31 is in the normal position (nozzle down), and then resets and starts an internal timer (S14). Thereafter, the inkjet head elevation controller 120 determines, based on a detection signal from the first tablet sensor 33, whether the next tablet Tb arrives at the tablet detection position Pd (S16), and whether the end condition is met (S17), while repeatedly determining whether a predetermined time T1 (set to 10 seconds, for example) has passed from the of the timer, that is, from the timing of detection of the tablet Tb on which to print (S15: a time determination unit/a determination unit, a determination step).

Hence, the inkjet head elevation controller 120 includes the determination unit (time determination unit). The determination unit determines whether the tablet Tb arrives at the print position, according to whether the above-mentioned predetermined time T1 has passed from the timing of detection of the tablet Tb on which to print. In other words, the predetermined time T1 is a preset reference of arrival of the tablet. Note that the predetermined time T1 may be set as a previously obtained time in which ink on the tip end of the nozzles does not dry and cause ejection failure when printing the next tablet Tb. The predetermined time T1 is determined by drying characteristics of the ink, a distance between the nozzles and the conveyor belt, and a wind speed of suction of air.

If the next tablet Tb arrives at the tablet detection position Pd in this process and it is determined that the tablet Tb is in the tablet detection position Pd (YES in S16), the inkjet head elevation controller 120 resets and starts the internal timer (S14), and performs the same processing (S15, S16, S17) as mentioned earlier. In the first conveyor mechanism 17, while the tablets Tb are appropriately sorted on the conveyor belt 17 and conveyed, the inkjet head elevation controller 120 repeats the aforementioned processing (S15, S16, S17), and characters, marks and the like are printed on the tablets Tb in the aforementioned manner in the process.

Figure 9:
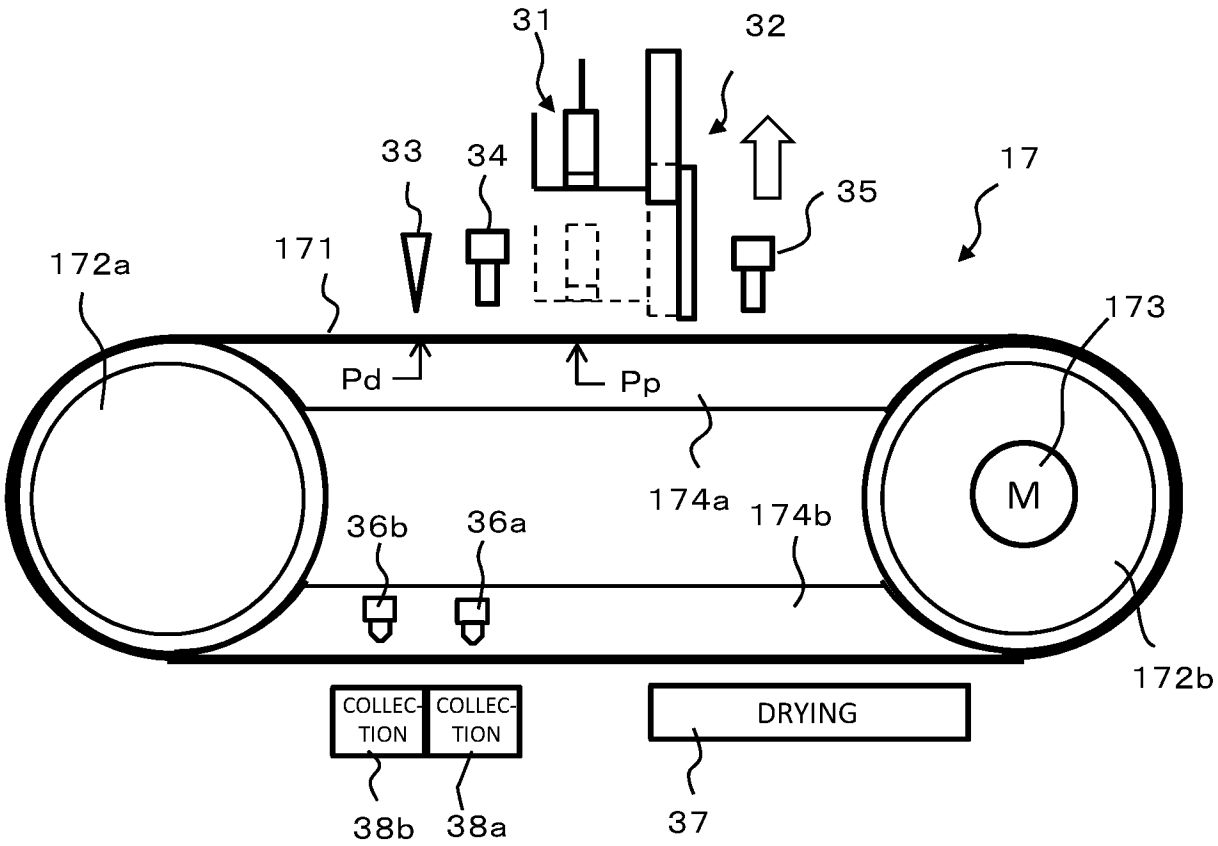
FIG. 9 is a diagram showing a state where the inkjet head provided in the first conveyor mechanism has moved to a retreat position.

On the other hand, in the first conveyor mechanism 17, if the tablet Tb is not detected in the tablet detection position Pd by the first tablet sensor 33 due to reasons such as jamming of the tablet Tb in the first vibrating feeder 12*a* or the second vibrating feeder 12*b*, failure in continuous transfer of tablets Tb in the first transfer feeder 13 or the second transfer feeder 16, and failure in adsorbing of tablets Tb onto the conveyor belt 171 in the first conveyor mechanism 17, the inkjet head elevation controller 120 starts the internal timer (S14), and then determines (YES in S15: a determination step) that the predetermined time T1 has passed (time up) before detection of the next tablet Tb (NO in S16). In this case, the inkjet head elevation controller 120 detects the state where the tablet Tb does not arrive at the print position Pp, transitions to the procedure shown in FIG. 8B, and controls the first elevating mechanism 32 (S21: a head retraction control unit/a head retraction unit, a head retraction step) such that the first inkjet head 31 in the normal position rises (nozzle up) to a position indicated by a broken line in FIG. 9. Since the first inkjet head 31 thus rises to the retreat position, each nozzle having stopped ejecting ink drops is less likely to be affected by an airstream caused by the suction effect of the suction chamber 174*a*, above the print position Pp on the conveyor belt 171. The retreat position of the first inkjet head 31 is preferably set to a position where each nozzle of the first inkjet head 31 is not affected by the airstream caused by the suction effect of the suction chamber 174*a*, at the shortest distance from the conveyor belt 171. This can shorten the time required for retreat of the first inkjet head 31, and the time required for returning to the normal position, which will be described later.

Thereafter, the inkjet head elevation controller 120 resets and starts the internal timer (S22), determines whether the tablet Tb arrives at the tablet detection position Pd (S24) and whether the end condition is met (S25), while repeatedly determining (S23) whether a predetermined time T2 (set to 30 seconds, for example) has passed from the start of the timer, that is, from the timing of movement of the first inkjet head 31 to the retreat position. Note that the processing of step S23 and step S24 corresponds to the determination unit (the determination step) used when returning the first inkjet head 31 in the retreat position to the normal position. During the determination processing (S23, S24), if the reason that the tablet Tb does not arrive at the tablet detection position Pd (e.g., jamming of tablet Tb in first vibrating feeder 12*a* or second vibrating feeder 12*b*) is resolved and it is determined that the tablet Tb is in the tablet detection position Pd before passage of the predetermined time T2 (NO in S23, YES in S24), the inkjet head elevation controller 120 returns to the procedure shown in FIG. 8A to check that the first inkjet head 31 is in the retreat position (NO in S13), and controls the first elevating mechanism 32 to return the first inkjet head 31 in the retreat position to the normal position (S18: a head return control unit), Then, under control of the print controller 110, print processing on the tablet Tb detected in the tablet detection position Pd is resumed, according to a procedure as in the aforementioned procedure. When returning the first inkjet head 31 to the normal position and resuming the print processing, the time required for returning to the normal position from the retreat position is determined, based on the intervals between the tablets Tb fed from the second transfer feeder 16 side and the conveying speed thereof. In order to adjust the timing of returning the first inkjet head 31 to the normal position from the retreat position for the print processing and the timing of feeding of the tablets Tb, the conveying speed (rotation speed of conveyor belt 171) of the tablets Tb may be slowed down or be temporarily stopped. By performing such control, the retreat position can be determined without being limited by the intervals between the fed tablets Tb or the conveying speed.

Thereafter, the inkjet head elevation controller 120 repeats the same processing (S14 to S17) as mentioned earlier, and in this process, starts the internal timer (S14), and then controls (S21) the first elevating mechanism 32 such that the first inkjet head 31 rises to the retreat position every time it is determined (YES in S15) that the predetermined time T1 has passed (time up) before detection of the next tablet Tb (No in S16). Thereafter, if it is determined (YES in S24) that the tablet Tb is in the tablet detection position Pd before passage of the arbitrary predetermined time T2, the inkjet elevation controller 120 controls the first elevating mechanism 32 (S18) to return the first inkjet head 31 to the normal position.

Thereafter, during the aforementioned processing, if the predetermined time T2 passes (YES in S23) without detecting the next tablet Tb (NO in S24) after raising the first inkjet head. 31 to the retreat position (S21), the inkjet head elevation controller 120 causes the alarm 60 (a warning unit) to output warning information such as a warning sound and a warning message (S26). Then, the inkjet head elevation controller 120 repeatedly determines whether the tablet Tb is in the tablet detection position Pd (S11) and whether the end condition is met (S12) If a worker that notices the warning information stops the tablet printing apparatus for inspection, operation of all parts controlled by the controller 100 in the tablet printing apparatus stops, and processing of the inkjet head elevation controller 120 ends. Hence, if the tablets are caught and held up in the upstream of the first conveyor mechanism but the blockage is naturally solved and conveyance of the tablets is resumed, the print processing can be continued. If an inspection by the worker is required to resume the conveyance, recovery by the worker can be prompted. This can reduce load on the worker, and improve productivity.

Note that if the end condition is met (YES in S17) by a stop operation by the worker, for example, with no detection of the tablet Tb (NO in S16) after the start of the internal timer (S14) and before passage of the predetermined time T1 (NO in S15), or if the end condition is met (YES in S25) by a stop operation by the worker, for example, with no detection of the tablet Tb (NO in S24) after raising the first inkjet head 31 to the retreat position (S21) and before passage of the predetermined time T2 (NO in S23), processing of the inkjet head elevation controller 120 also ends.

According to raising and lowering control of the first inkjet head 31 by the tablet printing apparatus, if the first tablet sensor 33 does not detect the tablet Tb for the predetermined time T1, it is determined that the tablet Tb does not arrive at the print position Pp. Since the first inkjet head 31 is moved to the retreat position farther away from the conveyor belt 171, the tip end part of each nozzle of the first inkjet head 31 is less likely to be affected by an airstream caused by the suction effect of the suction chamber 174*a* of the first conveyor mechanism 17, when the tablet Tb does not arrive at the print position Pp. Hence, it is possible to prevent drying of ink on the tip end of each nozzle of the inkjet printing mechanism that occurs when the first inkjet head 31 does not print on the tablets Tb for a long period of time. As a result, when normal conveyance of the tablets Tb is resumed (YES in S24), ink drops can be ejected normally from the nozzles of the first inkjet head 31 immediately after its return to the normal position. Thus, optimal printing can be continued.

In the above example, although the first inkjet head 31 is raised to the retracted position upon occurrence of some conveyance failure (e.g., jamming of tablet Tb in first vibrating feeder 12*a* or second vibrating feeder 12*b*), the invention is not limited to this. For example, when performing maintenance of the first inkjet head 31 (multiple nozzles) periodically, or when changing the type of tablets to be printed, too, influence of the airstream can be suppressed by retreating the first inkjet head 31 from the surface of the conveyor belt 171 without stopping the suction effect of the suction chambers 174*a*, 174*b*. Since startup of the suction chambers 174*a*, 174*b* may take time, avoiding stoppage thereof at the time of maintenance of the first inkjet head 31 or change of tablet type can also reduce processing time.

Figure 10:
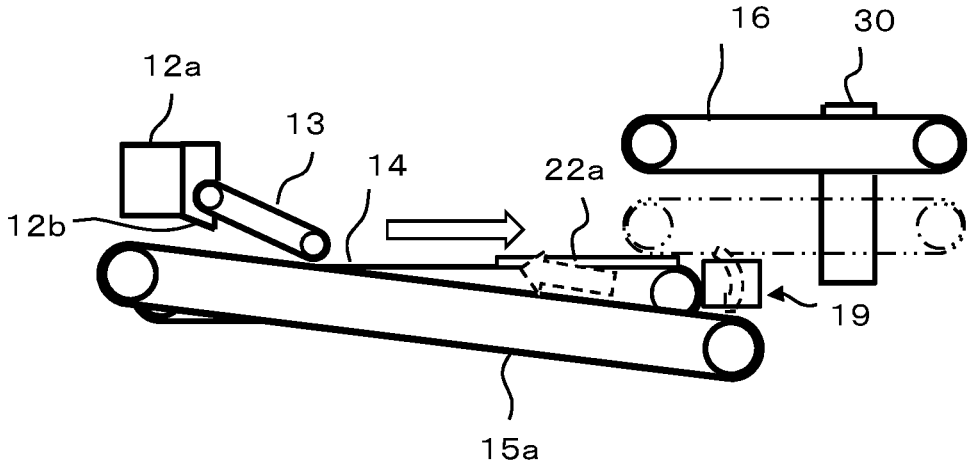
FIG. 10 is a diagram showing a state where the tablets flow into the return feeders from the alignment feeder, while the second transfer feeder is raised.

When performing periodic maintenance of the first inkjet head 31, the second transfer feeder 16 is raised by the elevating mechanism 30 as shown in FIG. 10, for example. when interrupting the feed from the second transfer feeder 16 to the first conveyor mechanism 17 in this manner, the print processing of the tablets Tb left in the first conveyor mechanism 17 and the second conveyor mechanism 18 may be completed, or the tablets Tb may be retained without being printed, and be circulated in each conveyor mechanism. In this case, the pulleys 172*b*, 182*a* may have a suction property. The printing process and maintenance may be switched automatically or manually. That is, the switching may be performed automatically after passage of a preset time, or a worker may perform maintenance when appropriate. Maintenance may be performed in the printing position, or may be performed by moving the inkjet head to a different position. Maintenance is performed when replacing or initially filling ink for switching of product type or start of operation, or during a long stop. At this time, a unit may be used which includes a drain pan for receiving ink dripping from the nozzles, a wiper (rubber, fabric) for cleaning a nozzle surface, and a suction nozzle.

When detection of the tablet Tb in the tablet detection position Pd stops due to shortage of tablets in the hopper 11 when changing the type of tablets Tb to be printed, the first inkjet head 31 rises to the retreat position according to the aforementioned procedure, and outputs warning information. Then, when a worker that notices the warning information inspects the parts and puts tablets Tb of a different type into the hopper 11, the different tablets Tb sequentially fed from the hopper 11 are conveyed by the first conveyor mechanism 17 and the second conveyor mechanism 18 as described earlier, and printing is performed on the tablets conveyed through the first conveyor mechanism 17 and the second conveyor mechanism according to the aforementioned procedure.

As described earlier, when performing maintenance or changing the type of tablets Tb by raising the first inkjet head 31 (second inkjet head 42), the suction effect through the conveyor belt 171 (181) is maintained. Hence, powder of the tablets Tb floating inside the tablet printing apparatus can be effectively collected in the suction chambers 174*a*, 174*b* (184*a*, 184*b*). As a result, the inside of the tablet printing apparatus can be kept clean.

Note that although the inkjet head moving mechanism in the above example is the first elevation mechanism 32 (second elevation mechanism 42) that raises and lowers the first inkjet head 31 (second inkjet head 41) between the normal position and the retreat position, the invention is not limited to this. For example, the mechanism may move the first inkjet head 31 (second inkjet head 41) in such a manner as to change the direction of the nozzles of the first inkjet head 31 (second inkjet head 41) facing the conveyor belt 171 (181).

Figure 11:
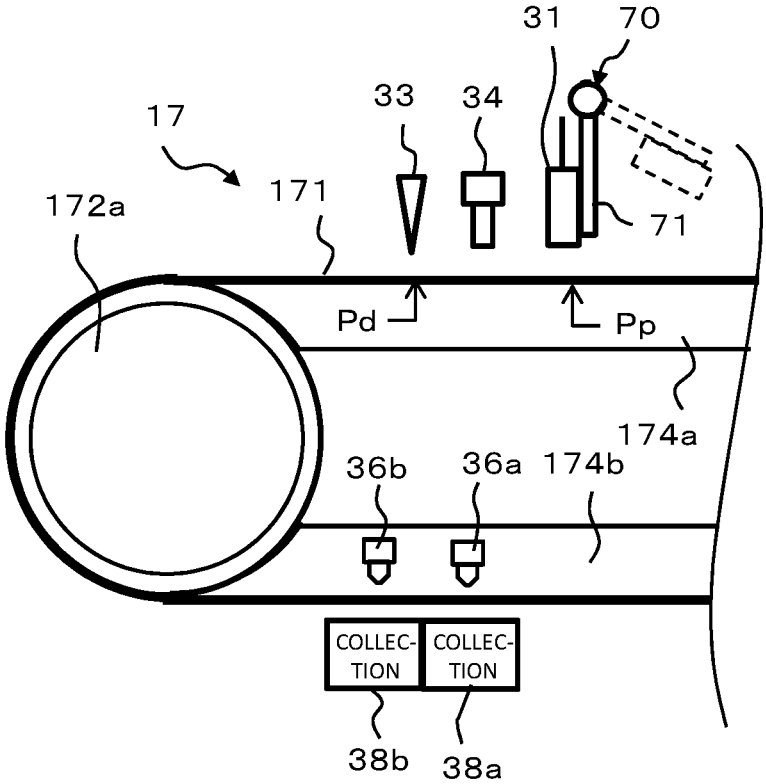
FIG. 11 is a diagram showing another example of an inkjet head moving mechanism that retreats an inkjet nozzle.
Figure 12:
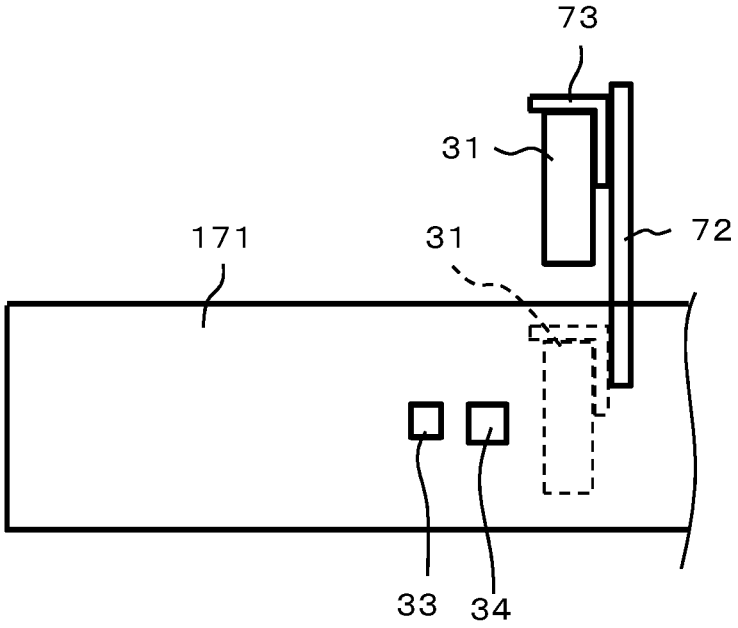
FIG. 12 is a diagram showing yet another example of the inkjet head moving mechanism that retreats the inkjet nozzle.

For example, the first inkjet head 31 (second inkjet head 41) may be configured to rotate or move horizontally to retreat from the print position, to a position where drying of the nozzles can be prevented. Specifically, in the case of rotating the first inkjet head 31, the first inkjet head 31 may be fixed to a bracket 71 rotated by a rotary mechanism 70 as shown in FIG. 11. In this case, the rotation of the bracket 71 by the rotary mechanism 70 can move the first inkjet head 31 between a normal position where printing is performed and a retreat position. In the case of moving the first ink head 31 horizontally, the first inkjet head 31 may be fixed to a bracket 73 that is moved, by a slide mechanism 72, forward and rearward in a direction that crosses (perpendicular to) the conveying direction of the conveyor belt 171 as shown in FIG. 12, for example. In this case, the forward and rearward movement of the bracket 73 by the slide mechanism 72 moves the first inkjet head 31 frontward and rearward between a normal position where printing is performed and a retreat position. Note that the position where drying of the nozzles can be prevented, that is, the distance to which the first inkjet head 31 is rotated or moved horizontally is preferably set to a position where each nozzle of the first inkjet head 31 is not affected by an airstream caused by the suction effect of the suction chamber 174*a*, at the shortest distance from the conveyor belt 171.

Although the above embodiment illustrates an example in which printing is performed on both faces of the tablet Tb, the invention is not limited to this, and printing may instead be performed on just one face.

Figure 13A:
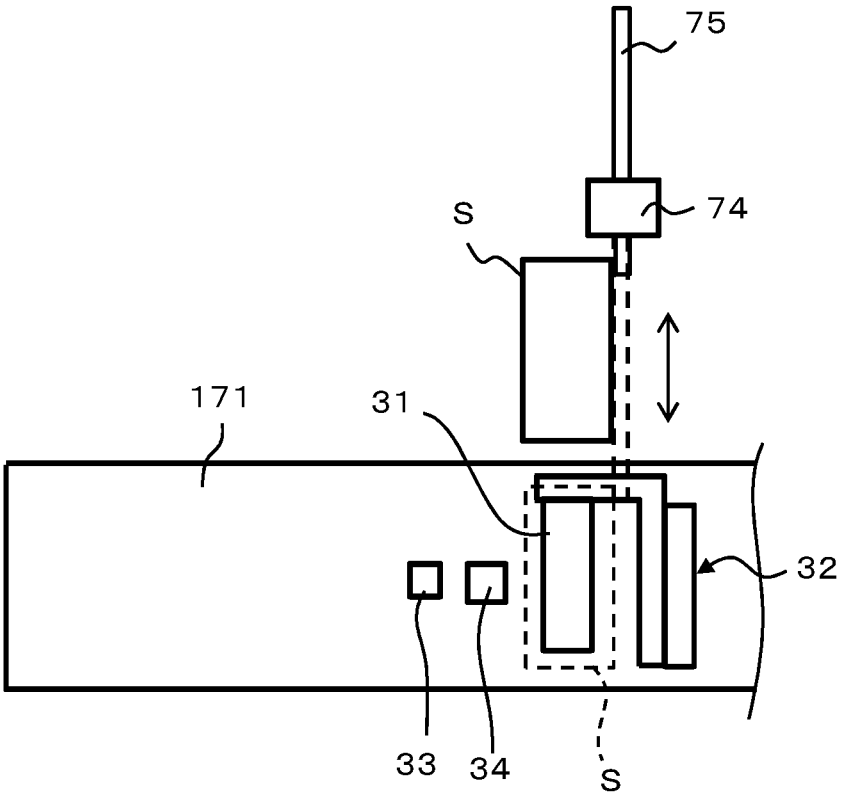
FIG. 13A is a plan view showing an example of a shutter (airstream shutoff member) that shuts off influence of an airstream on nozzles of the inkjet head and a drive mechanism thereof.
Figure 13B:
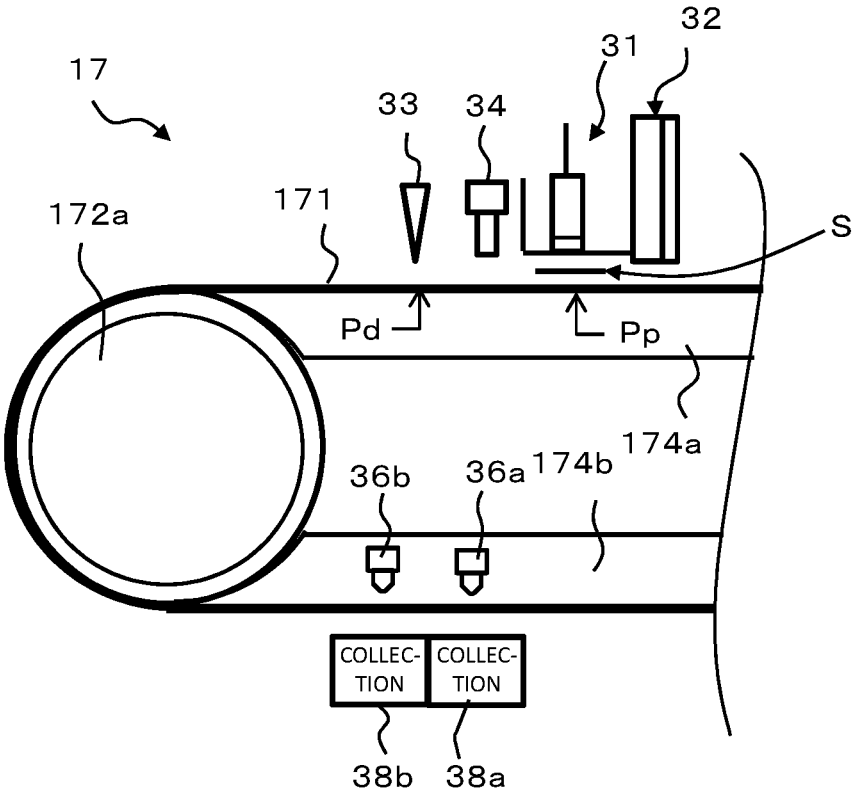
FIG. 13B is a side view showing the shutter (airstream shutoff member) that shuts off influence of an airstream on the nozzles of the inkjet head.

In the above embodiment, influence of the airstream caused by suction of air is avoided by retreating the first inkjet head 31 (second inkjet head 41). However, as long as the influence of the airstream can be shut off, a shutter S (airstream shutoff member) inserted between the tip end parts of the nozzles of the first inkjet head 31 and the conveyor belt 171 may shut off the airstream (an airstream shutoff step), as shown in FIGS. 13A and 13B. The shutter S (see FIG. 13B) thus placed at a height where it is inserted between the tip end part of the nozzles and the conveyor belt 171 is fixed to a slide bar 75 that is moved, by a solenoid 74, forward and rearward in a direction that crosses (perpendicular to) the conveying direction of the conveyor belt 171. The operation of the solenoid 74 moves the shutter S frontward and rearward (see FIG. 13A) between a retreat position where it does not overlap the print position and a shutoff position directly below the first inkjet head 31 (second inkjet head 41). Since such a shutter S is formed by merely moving a light plate member between the retreat position and the shutoff position, printing can be started in a shorter time than time required for returning of the first inkjet head 31 (second inkjet head 41) from the retreat position. Hence, productivity can be improved. Alternatively, the first inkjet head (second inkjet head 41) may be moved by a certain height to allow insertion of the shutter S. In this case, also, the moving distance of the first inkjet head 31 (second inkjet head 41) can be kept as short as possible, whereby productivity can be improved. Alternatively, the shutter S may be inserted in a position facing to the nozzle surface of the first inkjet head 31 (second inkjet head 41) between the conveyor belt 171 and the suction chamber 174*a*. The shutter S may be used as the aforementioned drain pan. By ejecting ink in a minute amount, drying of the nozzles can be securely prevented.

Although the above embodiment illustrates an example using the first vibrating feeder 12*a* and the second vibrating feeder 12*b*, the invention is not limited to this, and the configuration may include one or more than two vibrating feeders. Instead, the tablets Tb may be directly fed to the alignment feeder without using a vibrating feeder.

Although the normally printed tablets Tb are housed in the storage tray 50 in the above embodiment, the invention is not limited to this, and the tablets Tb may be continuously discharged to a belt conveyor or the like to the next step. Multiple storage trays 50 may be prepared, and a replacement function may be provided to replace the storage tray 50 when it becomes full. This can shorten the time of holding the printed tablets Tb housed in the accommodation tray 50, and move the printed tablets Tb immediately to the next step. Hence, productivity can be improved.

Although the above embodiment illustrates an example including only one each of the alignment feeder 14, the first transfer feeder 13, and the second transfer feeder 16, the invention is not limited to this, and the configuration may include multiple units of each feeder.

Although the above embodiment illustrates an example in which the conveyor belts 171, 181 are gas permeable and allow the tablets Tb to be adsorbed on the entire surface thereof, the invention is not limited to this, as long as the tablets Tb on the conveyor belts 171, 181 can be adsorbed and held by the effect of the suction chambers 174*a*, 174*b*, 184*a*, 184*b*. For example, pockets may be provided in the conveyor belts 171, 181, and the pockets and the suction chambers 174*a*, 174*b*, 184*a*, 184*b* may be connected to adsorb and hold the tablets Tb. The pocket may be formed into a slit extending in the longitudinal direction of the conveyor belt, and a suction hole connecting the slit and the suction chambers 174*a*, 174*b*, 184*a*, 184*b* may be provided. The slit may be a slit-like opening provided over almost the entire periphery of the conveyor belts 171, 181, or may be openings provided at predetermined intervals. The conveyor belts 171, 181 may be provided next to each other in a direction perpendicular to the moving direction to hold the tablets across the two conveyor belts, and the suction chambers 174*a*, 174*b*, 184*a*, 184*b* may connect the two conveyor belts and suck in air to adsorb and hold the tablets Tb. This configuration can eliminate the need of special belts such as a gas permeable meshed sheet and a belt with holes.

Although the above embodiment illustrates an example in which the conveyor belts 171, 181 are wound around two pulleys, the invention is not limited to this, and the configuration may include three or more pulleys. For example, the first conveyor mechanism 17 may be configured of a total of four pulleys including three pulleys 172*a*, with one of the three pulleys being movable. This configuration allows easy replacement of belts.

Although the above embodiment illustrates an example including multiple suction chambers in each of the first conveyor mechanism 17 and the second conveyor mechanism 18, the invention is not limited to this, and each conveyor mechanism may instead include a single chamber. Instead, a part of the print position (part immediately below inkjet head) may be configured as a separate suction chamber. In this case, the chamber in the print position may be the only separate suction chamber having a strong suction response, and suction pressure can be controlled individually. Thus, instead of retreating the inkjet head, the inkjet head can be controlled to avoid influence of the airstream by weakening the sucking, whereby the mechanism and control can be simplified.

The above embodiment illustrates an example including the first transfer feeder 13. As mentioned earlier, the first transfer feeder 13 can prevent vibration caused by dropping of the tablets Tb onto the alignment feeder, as compared to direct feeding from the second vibrating feeder 12*b* to the alignment feeder 14. Hence, the tablets Tb can be transferred to the alignment feeder 14 in a stable position. However, influence of the vibration caused by dropping may be small, depending on the size and shape of the tablet Tb. In this case, the first transfer feeder 13 may be omitted. By omitting the first transfer feeder 13, the configuration and control of the tablet printing apparatus can be simplified.

Although the above embodiment illustrates an example in which two collection trays (38*a*, 38*b*, 48*a*, 48*b*) are provided in each of the first conveyor mechanism 17 and the second conveyor mechanism 18, the invention is not limited to this, and the number of trays may be one or more than two. For example, while the tablets Tb in the collection tray that collects tablets Tb including damage such as chipping and tablets Tb that are poorly printed may be discarded, the tablets Tb in the collection tray that collects tablets Tb that are not printed for some reason may be returned to the hopper 11 and be printed. Since the tablets Tb can be collected according to different states, they need not be sorted afterwards. Moreover, tablets Tb not including damage but poorly printed such as an erroneous print position, which can be recovered by re-coating, for example, may be sorted further. If sorting is unnecessary, the tablets Tb may all be collected in one collection tray.

Although the above embodiment illustrates an example in which the retreat positions of the first inkjet head 31 and the second inkjet head 41 are determined only for the purpose of preventing drying of the nozzles, the invention is not limited to this. Instead, a maintenance position for retreating for a distance to secure work area for maintenance of the first inkjet head 31 and the second inkjet head may be provided.

Although the above embodiment illustrates an example in which the first conveyor mechanism 17 and the second conveyor mechanism 18 are separated by a certain gap at the transferring part, and the tablets Tb are dropped by no longer being adsorbed, the invention is not limited to this. Instead, the tablets Tb may be sandwiched between the conveyor belt 171 of the first conveyor mechanism 17 and the conveyor belt 181 of the second conveyor mechanism 18 and transferred. This avoids impact on the tablet Tb, and can suppress damage on the tablet Tb. This is not limited to the first conveyor mechanism 17 and the second conveyor mechanism 18, and the same applies to the first transfer feeder 13 and the second transfer feeder 16.

Although the above embodiment illustrates an example including two return feeders, the invention is not limited to this, and may include one.

Although not particularly stated in the above embodiment, if the print position is shifted for a certain amount in a print state checked by the first print check camera 35 and the second print check camera 45, the print position may be changed to correct the shift amount.

The above embodiment illustrates an example in which the height of the first inkjet head 31 (second inkjet head 41) is changed for retreat at a timing when printing is not performed. However, if the distance between the tablet Tb and the nozzle surface is unstable due to variation in the size and position of the tablets Tb, the height of an upper face of the tablet may be measured, and the measured value may be used to perform control to keep the distance between the tablet Tb and the nozzle surface constant. The measurement may be based on an offline measured value, or the value may be measured by providing a height detection unit in the apparatus. For example, output of a tablet sensor configured of a reflective optical sensor may be used. Height control may be performed in real time for each tablet Tb, or the height may be detected at constant intervals to perform control.

Although the above embodiment does not describe the temperature of ink ejected from the first inkjet head 31 and the second inkjet head 41, since viscosity of ink changes depending on the temperature, and the ejection amount may vary, the temperature inside the first inkjet head 31 and the second inkjet head 41 may be controlled. The ejection amount may be changed appropriately by controlling the temperature.

The above embodiment illustrates an example in which the inkjet head is retreated when printing is not performed continuously. Even when the inkjet head is retreated, ink inside the nozzle may dry if inkjet head is left without printing for a long time. In this case, printing may be performed for a predetermined number of times or period of time until the print state becomes stable, and the tablets Tb printed at timings of unstable printing may be tracked and collected. Note that the ejection pattern at this time may be a test pattern using ejection from every nozzle instead of the characters normally printed on the tablet Tb. By ejecting from every nozzle, the ejection can be stabilized in a short time.

The first drying unit 37 and the second drying unit 47 in the above embodiment can be implemented by using a heater such as an infrared (IR) heater, blowing warm air, or adjusting the temperature of the conveyor system, and the method may be selected appropriately depending on the type of the tablet Tb and the type of ink, for example, to be treated. Multiple drying units may be combined. Drying may be omitted, depending on the state of the surface of the tablet Tb and the time required to dry the ink. In this case, the drying unit may be omitted for simplification, or use of an already provided drying unit may be stopped.

Printing by the first inkjet head 31 and the second inkjet head 41 may respectively be synchronized with the conveying operation of the first conveyor mechanism 17 and the second conveyor mechanism 18. A drive signal or an encoder pulse to a motor, or movement detection of a belt may be used as a synchronization signal. In this case, not only can defective tablets be collected, but also printing can be stopped when the tablet arrives at the print position if printing is likely to be poor due to an erroneous position.

Although some embodiments of the present invention have been described, the embodiments are presented as mere examples, and are not intended to limit the scope of the invention. The new embodiments described above can be implemented in other various forms, and various omissions, replacements, and changes may be made without departing from the gist of the invention. The embodiments and modifications thereof are included in the scope and gist of the invention, and are included in the invention and its equivalents described in the scope of claims.

REFERENCE SIGNS LIST

11 hopper
12*a* first vibrating feeder
12*b* second vibrating feeder
13 first transfer feeder
14 alignment feeder
15*a*, 15*b* return feeder
16 second transfer feeder
17 first conveyor mechanism
18 second conveyor mechanism
19 guide unit
21 sorting guide
22*a*, 22*b* alignment guide
23, 24 return guide
30 elevating mechanism
31 first inkjet head
32 first elevating mechanism
33 first tablet sensor
34 first posture check camera
35 first print check camera
36*a*, 36*b* air injection nozzle
37 first drying unit
38*a*, 38*b* collection tray
41 second inkjet head
42 second elevating mechanism
43 second tablet sensor
44 second posture check camera
45 second print check camera
46*a*, 46*b* air injection nozzle
47 second drying unit
48*a*, 48*b* collection tray
50 storage tray
60 alarm
100 controller
110 print controller
120 inkjet nozzle elevation controller
131 conveyor belt
132*a*, 132*b* pulley
133 suction chamber
171 conveyor belt
172*a*, 172*b* pulley
173 encoder
174*a*, 174*b* suction chamber
181 conveyor belt
184*a*, 184*b* suction chamber

The invention claimed is:

1. A tablet printing apparatus comprising:

a conveyor mechanism that conveys sequentially fed tablets by moving a conveyor belt;

a printing mechanism that has an inkjet head including a plurality of nozzles ejecting ink drops, the inkjet head being arranged to face to a surface of the conveyor belt, and performs printing on a tablet in a print position on the conveyor belt by ejecting ink drops from the plurality of nozzles onto the tablet according to print data;

a suction mechanism that holds a tablet on the surface of the conveyor belt in a predetermined area including at least the print position by sucking in air;

a detector that outputs a detection signal based on presence or absence of a tablet on the conveyor belt in a predetermined position on the upstream side of the print position in a conveying direction of the tablet;

a timer that measures time from detection of a tablet by the detector;

a determination unit that determines, based on measuring time of the timer and the detection signal from the detector, whether a tablet arrives at the print position according to whether a tablet is detected again by the detector within a predetermined time (T1) from the detection of a tablet by the detector;

an inkjet head moving mechanism that moves the inkjet head between a normal position where printing is performed on a tablet, and a retreat position farther away from the surface of the conveyor belt than the normal position;

a head retreat control unit that controls the inkjet head moving mechanism such that the inkjet head moves from the normal position to the retreat position, when the determination unit determines that a tablet does not arrive at the print position within the predetermined time (T1), wherein the timer further measures time from after the inkjet head moves in the retreat position, and the determination unit further determines, based on the measured time by the timer from after the inkjet head moves to the retreat position and on the detection signal from the detector, whether a tablet arrives at the print position within a predetermined time (T2) from after the inkjet head moves to the retreat position, and the tablet printing apparatus further comprising:

a head return control unit that controls the inkjet head moving mechanism such that the inkjet head moves from the retreat position to the normal position, when the determination unit determines that tablet arrives at the print position within the predetermined time (T2) from after the inkjet head moves to the retreat position.

2. The tablet printing apparatus according to claim 1, further comprising a warning unit that gives a warning if the determination unit does not determine that a tablet arrives at the print position within a predetermined time (T2) from after the inkjet head moves to the retreat position.

3. The tablet printing apparatus according to claim 2, wherein the inkjet head moving mechanism includes an elevating mechanism that moves the inkjet head between the normal position and the retreat position which is farther away from the surface of the conveyor belt in the vertical direction than the normal position.

4. The tablet printing apparatus according to claim 2, wherein the inkjet head moving mechanism includes a rotary mechanism that moves the inkjet head by rotation between the normal position and the retreat position which is farther away from the surface of the conveyor belt than the normal position.

5. The tablet printing apparatus according to claim 2, wherein the inkjet head moving mechanism includes a slide mechanism that moves the inkjet head between the normal position and the retreat position which is farther away from the surface of the conveyor belt in the horizontal direction than the normal position.

6. The tablet printing apparatus according to claim 1, wherein the inkjet head moving mechanism includes an elevating mechanism that moves the inkjet head between the normal position and the retreat position which is farther away from the surface of the conveyor belt in the vertical direction than the normal position.

7. The tablet printing apparatus according to claim 1, wherein the inkjet head moving mechanism includes a rotary mechanism that moves the inkjet head by rotation between the normal position and the retreat position which is farther away from the surface of the conveyor belt than the normal position.

8. The tablet printing apparatus according to claim 1, wherein the inkjet head moving mechanism includes a slide mechanism that moves the inkjet head between the normal position and the retreat position which is farther away from the surface of the conveyor belt in the horizontal direction than the normal position.

* * * * *